US006145717A

United States Patent [19]

Rebeck

[11] Patent Number: 6,145,717

[45] Date of Patent: Nov. 14, 2000

[54] HOLDER FOR PUSH POLES AND OTHER TUBULAR IMPLEMENTS

[76] Inventor: Ronald G. Rebeck, 31 Cunningham Rd., DeBary, Fla. 32713

[21] Appl. No.: 09/200,507

[22] Filed: Nov. 26, 1998

Related U.S. Application Data

[60] Provisional application No. 60/067,302, Nov. 28, 1997.

[51] Int. Cl.[7] ..... A45F 5/00

[52] U.S. Cl. ..... 224/268; 224/242; 224/245

[58] Field of Search ..... 224/268, 270, 224/269, 666, 673, 922, 247, 248, 197, 200, 242, 245, FOR 324; D3/221

[56] References Cited

U.S. PATENT DOCUMENTS

| | | | |
|---|---|---|---|
| 2,423,531 | 7/1947 | Theis | 224/182 |
| 4,431,122 | 2/1984 | Garmong | 224/268 |
| 4,569,466 | 2/1986 | Webber . | |
| 5,248,072 | 9/1993 | Jones | 224/247 |
| 5,564,610 | 10/1996 | Barron | 224/268 |
| 5,571,228 | 11/1996 | McMurtrie | 43/21.2 |
| 5,573,167 | 11/1996 | Bebb et al. | 224/666 |
| 5,687,892 | 11/1997 | Johns | 224/268 |
| 5,743,451 | 4/1998 | Kahn | 224/268 |

OTHER PUBLICATIONS

Mann's Spare Hand Rod Holder Advertisement, Item No. 3378 (1 page).

Third Hand Platform Pole Holder Advertisement (1 page).

*Primary Examiner*—Gregory M. Vidovich

*Assistant Examiner*—Maerema W. Brevard

*Attorney, Agent, or Firm*—Klarquist Sparkman Campbell Leigh & Whinston, LLP

[57] ABSTRACT

A holder for a push pole for maintaining a push pole within reach of a user includes a push pole holding portion and a mounting portion. The push pole holding portion is dimensioned to releasably hold the push pole. The mounting portion is configured to be positioned on the user's body.

14 Claims, 1 Drawing Sheet

HOLDER FOR PUSH POLES AND OTHER TUBULAR IMPLEMENTS

CROSS-REFERENCE TO RELATED APPLICATION

This application claims the benefit of U.S. Provisional Application No. 60/067,302, filed Nov. 28, 1997.

BACKGROUND OF THE INVENTION

1. Field of Invention

This invention relates to a holder for tubular implements, and in particular to a holder for a push pole commonly used to maneuver a shallow water fishing boat, e.g., a flats boat.

2. Description of Related Art

Flats boats are typically used in shallow water areas, such as the salt water flats for which they are named. Although flats boats typically have a mechanical means of propulsion (i.e., a motor driven propeller, a water jet or an air stream), these boats are also propelled by hand with a push pole. Push poles are typically relatively long (up to 23 feet), flexible, and lightweight members, usually made of plastic. Pilots maneuver their boats by thrusting the push pole into the surface beneath the shallow water and then pushing the boat in the desired direction of travel. In addition, the push pole can be used to steady or anchor the boat.

Frequently, the pilots need to secure the push pole temporarily to free their hands for other tasks while maintaining the pole in the water in a readily accessible position. Pilots usually use the push pole from a standing position on a poling platform that is several feet above the main deck of the boat. For example, the pilot may have an opportunity to cast to a fish, and thus needs to free his hands for making the cast without dropping the push pole in the water.

Push pole holders for securing the push pole to the deck of the boat for storage and transit to the flats are known. These deck-mounted holders are typically comprised of several blocks spaced apart over the length of the boat. The pole is secured to the blocks in a generally horizontal position parallel to the deck by elastic or other means attached to each block. A single poling platform-mounted block is also known. Such deck-mounted holders, however, do not permit the pole to be readily accessed. Similarly, the deck-mounted holder sold under the name Third Hand Platform Pole Holder also does not allow the pole to be readily accessed.

Also known are belt-worn fishing rod holders that allow a fishing rod to be kept close the wearer's body while freeing the wearer's hands. As is shown in U.S. Pat. No. 4,569,466, the fishing rod holder cradles the fishing rod in an angled position, and is typically worn on either the left or right side of the wearer's waist. Because these fishing rod holders are usually dimensioned to receive the reel section of the fishing rod and to hold it in an upwardly angled position, they are not suited for holding push poles. Also, push poles are much longer and heavier than fishing rods. Similarly, the Mann's Spare Hand Rod Holder, which is a belt-mounted rod holder, is not suitable for holding a push pole.

Therefore, it would be desirable to provide a push pole holder that enables a pilot to quickly and easily secure the push pole while maintaining it close at hand. Further, it would be desirable to allow the push pole to be secured without requiring the pilot to bend over, use both hands or direct his attention away from the water. These and other objects are accomplished by the holder of the claimed invention.

SUMMARY OF THE INVENTION

According to one aspect of the invention, the holder for a push pole includes apparatus for allowing a user to wear the holder (i.e., a mounting portion) and apparatus for releasably securing a push pole to the holder (i.e., a push pole holding portion).

Preferably, the holder is worn around the waist or body of the user, e.g., with a belt or strap passed through belt slots provided in the holder.

Preferably, the apparatus for releasably securing the holder includes a curved portion dimensioned to receive the push pole. Preferably, the curved portion and a rear portion of the holder engage the push pole at points around its circumference. The engagement between the push pole and the holder is preferably a "snap fit."

Preferably, the curved portion ends in curved lip with smooth edges to prevent the holder from undesirably catching on nearby objects.

The holder may be formed of one piece or, according to a second aspect of the invention, the push pole holding portion may be pivotably connected to the mounting portion. Preferably, the holder or at least one of the push pole holding portion and the mounting portion are made of a plastic material.

Preferably, the push pole holding portion is connected to the mounting portion with a fastener. Preferably, the fastener includes an outer fastener portion attached to a fastener shaft and an inner fastener portion configured to engage the fastener shaft. The inner fastener portion, which faces the user when the holder is worn, preferably includes a threaded insert in the mounting portion.

Preferably, the push pole holding portion includes stops to prevent the push pole from translating when the push pole is received in the push pole holding portion. The stops are preferably rubber grommets inserted in through holes extending through the push pole holding portion.

BRIEF DESCRIPTION OF THE DRAWINGS

The above and additional objects, features and advantages of the present invention will be better understood by reading the following detailed description of preferred embodiments of the invention when considered in conjunction with the accompanying drawings, in which.

DETAILED DESCRIPTION OF PREFERRED EMBODIMENTS

Figure 1:
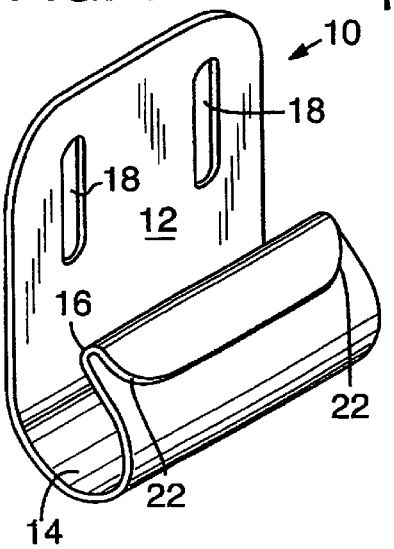
FIG. 1 is a front perspective view of the holder according to a first embodiment.

Referring to FIG. 1, a holder 10 for a push pole that is designed to be worn on a belt is shown. The holder has a back portion 12 intended to fit against the wearer's body. The back portion 12 may be straight (as shown) or slightly contoured to fit more closely around the wearer's body.

The back portion 12 is joined to a curved portion 14 having an approximately semicircular shape, which is in turn joined to a curved lip 16 also having an approximately semicircular shape. The curved portion 14 is dimensioned to hold the push pole. In a preferred embodiment, the curved portion 14 is dimensioned to have an opening slightly smaller than the diameter of the push pole, such that the push pole can be "snap fitted" into the holder 10 (see FIG. 4). Typical push poles have a circumference from 4.5 to 4.875 inches. In addition to the diameter of the push pole, the dimension of the opening in the curved portion 14 depends upon the material used for the curved portion 14 and the desired fit between the push pole and the holder 10, as are known to those of skill in the art.

Figure 2:
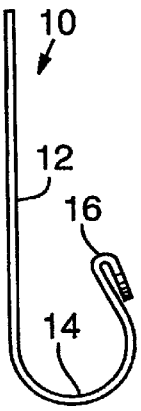
FIG. 2 is a side view of the holder of FIG. 1.

The curved lip 16 curves in a direction away from the curved portion 14 (FIG. 2) to provide a smoother termination. Preferably, the curved lip 16 is configured without protuberances or sharp edges that could catch clothing or lines. For example, the curved lip 16 has curved lip ends 22 that are rounded in the illustrated embodiment.

Figure 3:
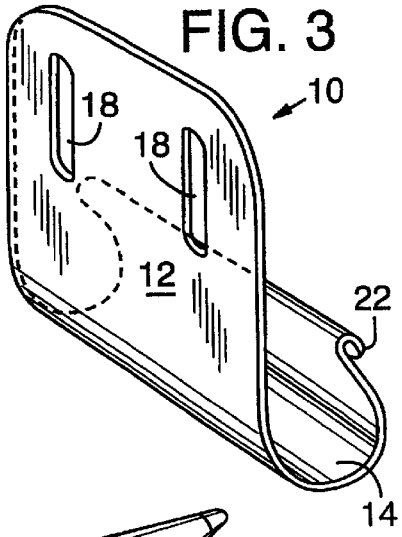
FIG. 3 is a rear perspective view of the holder of FIG. 1.

As shown in FIGS. 1 and 3, the back portion 12 includes belt slots 18. In the illustrated embodiment, two such belt slots 18 are shown. The belt slots 18 are dimensioned to receive a belt passed through the belt slots 18 for securing the holder 10 to the wearer. Alternatively, the holder 10 could be permanently attached to a dedicated belt, or to a harness or piece of clothing. Generally, the holder is worn on either hip so that the push pole extends forward and rearward with respect to the wearer when the push pole is secured in the holder.

Preferably, the holder is formed from a single piece of material, such as PETG (polyethylene terepthalate glycol-modified) sold under the trade name Durrplex, although other materials (e.g., sheet metal) could be used. Alternatively, the holder could be assembled from multiple pieces, e.g., if the curved portion 14 is connected by a hinge to the back portion 12 to allow the curved portion 14 to rotate relative to the back portion 12.

Figure 4:
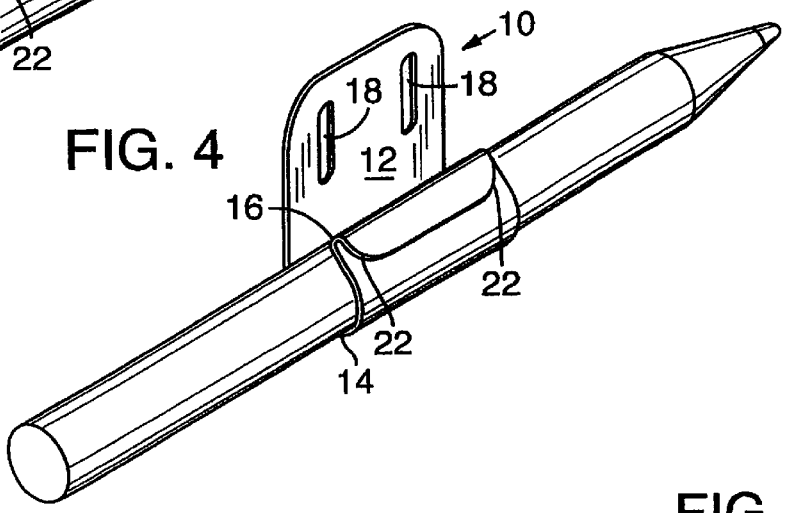
FIG. 4 is a perspective view showing a push pole secured in the holder of FIG. 1.

As shown in FIG. 4, the push pole 20 can be inserted into the holder 10 at any point along the length of the push pole 20. The push pole 20 is secured by contact at points around its circumference with the back portion 12 and curved portion 14. Because the holder 10 is intended to be worn at the wearer's waist, the holder 10 allows the wearer to quickly and easily secure the push pole 20 without bending over or using both hands.

Although the holder 10 has been described for use with a push pole, the holder 10 could be configured to secure any long, generally cylindrical object. For example, the holder 10 could be configured for use by electricians and plumbers to secure conduit or pipe within easy reach during installation.

Figure 5:
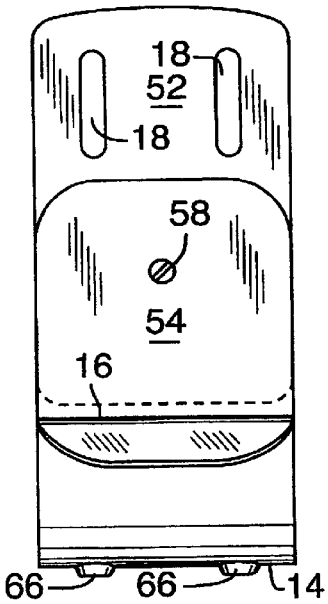
FIG. 5 is a front view of the holder according to a second embodiment.
Figure 6:
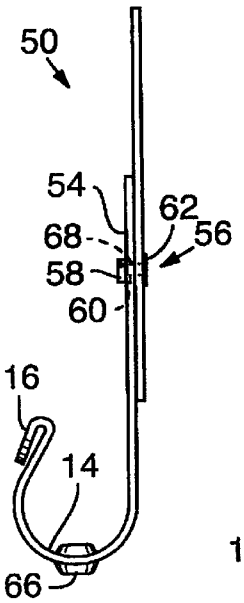
FIG. 6 is a side view of the holder of FIG. 5.
Figure 7:
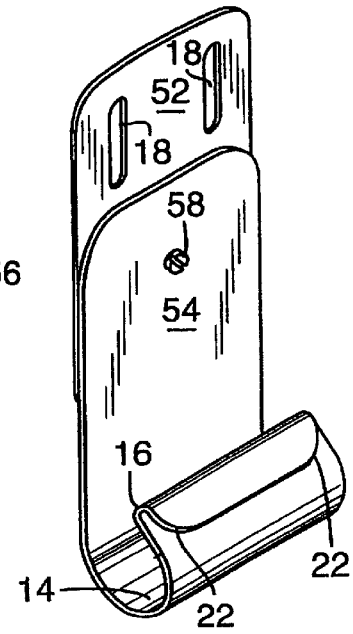
FIG. 7 is a front perspective view of the holder of FIG. 5.

FIGS. 5, 6 and 7 show a holder 50 according to a second embodiment of the invention. The holder 50 is essentially the same as the holder 10 of the first embodiment, except that the holder 50 includes a two-piece back portion that includes an upper back portion 52 pivotably connected to a lower back portion 54 and stops 66 to hold the push pole 20 more securely.

The upper back portion 52 and the lower back portion 54 are secured together by a fastener 56. The upper back portion 52 is mounted on the user's belt by the belt slots 18 as in the first embodiment. The upper side of the lower back portion 54 includes rounded edges 64 to prevent injury and interference from clothing and lines.

The fastener 56 allows the lower back portion 54 to rotate with respect to the upper portion 54, e.g., to allow the lower back portion 54 to be moved to a more convenient position while wearing the holder 50 without a push pole 20 or to allow the push pole 20 to be held at a more convenient angle. Thus, the fastener 56 must hold the upper back portion 52 and the lower back portion 54 together with sufficient tightness, yet still allow the lower back portion 54 to rotate easily with respect to the upper back portion 52. Also, the fastener 56 must continue to operate after exposure to the elements, especially salt water and the effects of corrosion.

In a preferred embodiment, the fastener 56 includes a outer fastener portion 58, a fastener shaft 60 extending through an aperture 68 and an inner fastener portion 58. Preferably, a nylon threaded screw is used for the outer fastener portion 58 and fastener shaft 60, and the inner fastener portion 58 is a threaded insert made of a non-corroding material having a low profile on the inner side of the lower back portion 54.

As shown, the stops 66 are mounted in the bottom of the curved portion 14. The stops 66 prevent the push pole 20 received in the curved portion 14 from slipping, e.g., when the push pole 20 is wet. Although two stops 66 are shown, any number may be used, and the stops 66 may be mounted at any position to contact the push pole 20. In a preferred embodiment, the stops 66 are rubber grommets mounted in through holes (not shown) in the curved portion 14.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A holder for a push pole for maintaining the push pole within reach of a user, comprising:

a push pole holding portion dimensioned to releasably hold a push pole, the holding portion having through holes and grommets inserted in the through holes that project from the push pole holding portion; and a mounting portion that is connected to the push pole holding portion and positionable on the user's body;

wherein the grommets contact the push pole and resist translational movement of the push pole when the push pole is received in the push pole holding portion.

2. The holder of claim 1, wherein the push pole holding portion and the mounting portion are formed as a single piece.

3. The holder of claim 2, wherein the holder is made of a plastic material.

4. The holder of claim 1, wherein the push pole holding portion includes a curved portion in which the push pole is receivable.

5. The holder of claim 4, wherein the curved portion terminates in a curved lip.

6. The holder of claim 1, wherein the push pole holding portion is configured to hold opposite side surfaces of the push pole by frictional engagement.

7. The holder of claim 1, wherein the push pole holding portion is pivotably connected to the mounting portion.

8. The holder of claim 7, wherein the push pole holding portion is made of a plastic material.

9. The holder of claim 7, wherein the mounting portion is made of a plastic material.

10. The holder of claim 7, wherein the push pole holding portion is connected to the mounting portion with a fastener.

11. The holder of claim 10, wherein the fastener includes an outer fastener portion attached to a fastener shaft and an inner fastener portion configured to engage the fastener shaft.

12. The holder of claim 11, wherein the inner fastener portion faces the user when the holder is worn, and includes a threaded insert in the mounting portion.

13. The holder of claim 11, wherein the outer fastener portion and the fastener shaft are made of nylon.

14. The holder of claim 1, wherein the mounting portion includes slots to receive a belt or strap to allow the holder to be worn by the user.

* * * * *